United States Patent [19]

Blessing

[11] Patent Number: 4,688,781

[45] Date of Patent: Aug. 25, 1987

[54] SEPARATING AND FEEDING FABRIC PARTS

[75] Inventor: Hubert Blessing, Dallas, Tex.

[73] Assignee: Levi Strauss & Co., San Francisco, Calif.

[21] Appl. No.: 649,503

[22] Filed: Sep. 11, 1984

[51] Int. Cl.[4] ..... B65H 5/10

[52] U.S. Cl. ..... 271/1; 271/11; 271/18.3; 271/128; 271/151; 271/146; 271/167; 271/243

[58] Field of Search ..... 271/1, 11, 14, 18, 18.3, 271/128–130, 150, 151, 154, 146, 167, 168, 243

[56] References Cited

U.S. PATENT DOCUMENTS

| | | | |
|---|---|---|---|
| 1,116,992 | 11/1914 | Carleton | 271/129 |
| 2,151,228 | 3/1939 | Pflanze | 271/1 |
| 2,584,730 | 2/1952 | Novick | 271/150 |
| 3,149,835 | 9/1964 | Branscome | 271/150 |
| 3,442,505 | 5/1969 | Szentkuti | 271/1 |
| 3,545,741 | 12/1970 | Porth | 271/146 X |
| 3,738,645 | 6/1973 | Gray | 271/168 X |
| 3,908,983 | 9/1975 | Long | 271/35 |
| 3,981,495 | 9/1976 | Bijttebier | 271/18.3 |
| 4,046,369 | 9/1977 | Kluge | 271/151 X |
| 4,049,260 | 9/1977 | Szymborski | 271/151 |
| 4,506,876 | 3/1985 | Nishibori | 271/167 X |
| 4,544,149 | 10/1985 | Graet | 271/146 X |
| 4,591,140 | 5/1986 | Illig | 271/146 X |

FOREIGN PATENT DOCUMENTS

| | | | |
|---|---|---|---|
| 998406 | 10/1976 | Canada | 271/129 |

*Primary Examiner*—Richard A. Schacher

*Attorney, Agent, or Firm*—Hubbard, Thurman, Turner & Tucker

[57] ABSTRACT

Stacked fabric parts are separated and fed seriatim by apparatus having an endless conveyor which feeds the stack into position for separating the uppermost part from the stack. A mechanism having a knife edge bar or opposed fabric engaging needles is lowered and engages the part for dragging the part to be separated off of the stack. The second part on the stack is held with the stack by a pressure force by a series of vacuum providing orifices or recesses in a horizontally disposed support surface and/or by retractable fabric piercing needles. The part separating and translating bar is connected to a support plate which may be vibrated in a generally horizontal plane to assist in breaking the frictional connection between the part to be separated and the remaining parts in the stack as they are separated from each other. The separated parts are presented seriatim to a guide surface which guides the part under the conveyance of an air jet stream along a feed path to another work station.

42 Claims, 15 Drawing Figures

SEPARATING AND FEEDING FABRIC PARTS

BACKGROUND OF THE INVENTION

1. Field of the Invention

The present invention pertains to apparatus for separating individual fabric parts from a stack and feeding the separated parts to a work station for further manufacturing operations. The apparatus is particularly adapted for separating fabric parts for apparel from a staggered or shingled stack.

2. Background

In the mass production of goods assembled from fabric parts, it is customary to cut a large number of parts simultaneously from a stack of plural layers or sheets of fabric followed by separation of the fabric layers for further operations. In the manufacture of goods such as shirts and pants, for example, various parts are subjected to preliminary sewing operations such as hemming and then restacked in one form or another and fed to a further operation. The parts are then normally required to be separated from the stack prior to each successive sewing operation. The separation of fabric parts from a stack of parts of like material is particularly difficult. The texture or surface roughness of the fabric causes the parts to cling to each other and resist separation techniques. Certainly, reliable separation processes must be implemented to facilitate the automation of the manufacturing process.

Although various devices have been developed for separating relatively thin or sheetlike fabric parts from a stack wherein the parts are aligned with each other, it has been determined that by providing a stack of parts wherein the parts are somewhat staggered so that corresponding edges of adjacent parts are arranged somewhat like roof shingles, hence a shingled stack, that improved separation techniques are possible. Staggering the edges of parts of a stack which are aligned with each other at the time of cut out of the parts may be obtained by various methods such as clamping one edge of the stack and rotating the other edge, then clamping the stack adjacent the other edge and releasing the stack at the first point of clamping to permit the stack to remain in the staggered or shingled configuration. Certain manufacturing process in the fabrication of apparel parts also inherently discharge the parts from a work station into a staggered or shingled stack configuration.

Accordingly, it has been determined in accordance with the present invention that the provision of a staggered or shingled stack is superior to aligned stacks of parts as regards separation processes, and improved apparatus is provided for separating the parts from the stack and feeding the parts to a further work operation in the fabrication of various articles.

SUMMARY OF THE INVENTION

The present invention provides improvements in separating and feeding or transferring pieces of relatively flexible fabric such as fabric parts of various articles of apparel from a stack of such parts, even though the parts may be formed of various types of fabric having a tendency to cling or resist separation from adjacent parts in the stack.

In accordance with one aspect of the present invention there is provided an improved apparatus particularly adapted for separating and tranferring individual fabric parts arranged in a staggered or so-called shingled stack or parts. The parts are stacked such that an edge, which may be hemmed or not, or a portion of a surface of the part may be positively engaged by a member connected to a transfer mechanism for moving the part engaged by the member to separate the engaged part from a stack of similar parts.

In accordance with another aspect of the present invention an apparatus is provided for separating and transferring individual fabric parts which have been presented to the apparatus in a stack wherein corresponding edges of each part are staggered or arranged with respect to each other in a shingled or cascade configuration. In one embodiment of the apparatus separation is carried out by utilizing a source of vacuum to hold the next to be separated part on a surface adjacent to a conveyor which has presented the edge of the stack, including the part to be separated and the next to be separated part, to a separating and transfer mechanism including a knife edge or other positive engaging mechanism which is engageable with the part to be separated.

The next to be separated part and other parts in the stack may also be held back during the separation process by means positively engaging the part next to the part to be separated. Such means may include retractable pins which are engageable with the part contiguous with the part to be separated. By applying a vacuum or positive engagement hold back force on the edge of the next to be separated part and positively engaging the part presented for separation, the part to be separated may be easily pulled free of the stack and transferred to a reference or guide surface for further movement by suitable conveyor means. If parts having hemmed edges are being separated the hemmed edge itself is advantageously utilized for engagement with the separating and transfer mechanism and with the reference surface for proper orientation of the part for further transport.

In accordance with still another aspect of the present invention an apparatus is provided which inclues a member engageable with a part to be separated from a stack and connected to means for vibrating the part engaging member to assist in separating the part to be transferred from the stack without dragging the next to be separated part along with the first mentioned part. By vibrating the part engaging member in a direction generally in line with the direction of movement of the part in the separation step, fabric parts of various types of material may be easily separated with or without interposing mechanical separation means between the parts to be separated and without mechanically engaging or holding the stack.

In accordance with still a further aspect of the present invention an apparatus is provided which is operable to separate fabric parts from a staggered or shingled stack, which stack is presented to a linearly reciprocable transfer mechanism having a member for engagement with the part to be separated and wherein the stack is presented to the separating mechanism by a conveyor which is controlled to feed the stack until such part is presented properly oriented and at the proper point for engagement by the separating mechanism.

The overall combination of a linearly reciprocable separating and transfer mechanism including a knife edge or other member for engaging a fabric part to be separated from a stack of similar fabric parts, wherein the next to be separated part is held back from movement with the part in position to be separated by pressure air, a vacuum source or mechanical hold back means and wherein a vibrating mechanism is operatively connected to the member engageable with the part to be separated provides a separating and transfer mechanism which is operable to separate fabric parts of various types of material in a positive manner and without regard for the frictional properties of various materials.

The present invention still further provides an improved method of separating and feeding fabric parts from a stack wherein a staggered or so-called shingled stack is provided and presented to a separating and feeding apparatus wherein the uppermost part in the stack is separated from the stack and wherein the part to be separated is positively engaged by a separating and transport mechanism and the next to be separated part is held back by means including a fluid pressure generated force or by a mechanical hold back device.

The present invention still further contemplates the provision of a system for handling and performing operations on fabric parts wherein one or more separating and feeding apparatus in accordance with the present invention are provided and shingled stacks of fabric parts are supplied to the apparatus on a continuous basis from a previous fabric operation station.

Although the invention is particularly adapted for separating parts which have been presented to the apparatus in a staggered or so-called shingled stack those skilled in the art will appreciate that the various features of the apparatus described and claimed herein may be used in conjunction with separating fabric parts from stacks of parts which are arranged otherwise relative to each other. Those skilled in the art will also further appreciate the above-mentioned features and advantages of the invention as well as additional superior aspects thereof upon reading the detailed description which follows in conjunction with the drawing.

DESCRIPTION OF THE PREFERRED EMBODIMENTS

Figure 1:
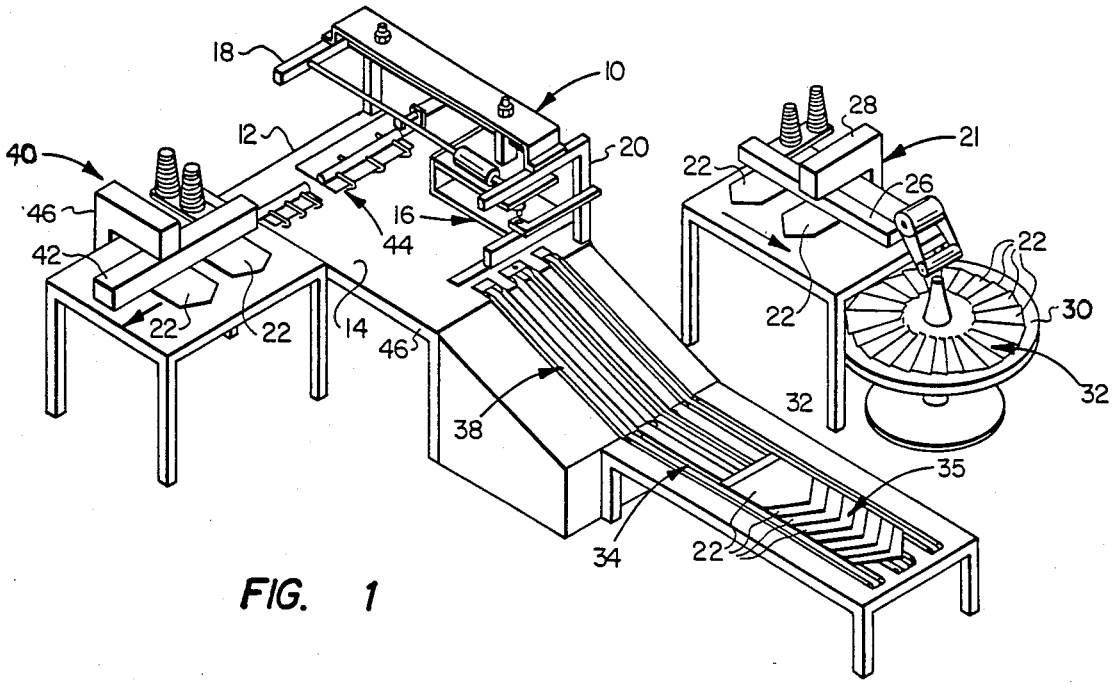
FIG. 1 is a perspective view in somewhat schematic form of the apparatus of the invention used in conjunction with a system for performing operations on fabric parts such as hemmed pocket parts for pants and other articles of apparel.

In the description which follows like parts are marked throughout the specification and drawing with the same reference numerals, respectively. The drawing is not necessarily to scale and certain features may be shown exaggerated in scale or in somewhat schematic form in the interest of clarity and conciseness.

The apparatus of the present invention is particularly adapted for use in conjunction with the automaed manufacture of articles of apparel such as denim trousers or jeans and for handling certain parts of the trousers in the various stages of the manufacturing process. In particular, the embodiments of the apparatus described in detail herein are utilized for separating precut pieces of fabric for pocket parts for denim trousers, which pieces may be hemmed along the top edge of the pocket part and stacked in a staggered or shingled configuration wherein the parts are oriented relative to each other in the same direction and the corresponding edges are staggered so that an edge of a hem of each part, if provided, is presented to the apparatus for separation of the top part of a stack from the remainder of the stack. Those skilled in the art will recognize that the apparatus may be used in conjunction with separating and feeding various other stacked fabric parts of different sizes and configurations and composed of other fabric material. The parts may not necessarily need to be hemmed although parts having a hemmed edge or other surface which may be positively interlocked or engaged with one embodiment of the mechanism of the apparatus are handled with particular ease.

Referring now to FIG. 1, the apparatus of the present invention is generally designated by the numeral 10. The apparatus 10 preferably includes a tablelike frame member 12 forming a generally horizontal support surface 14 above which is disposed a part separating and transfer carriage, generally designated by the numeral 16. The carriage 16 is suitably mounted on support structure including spaced apart upstanding bracket members 18 and 20.

The separating and feeding appaatus 10 may be used in conjunction with various manufacturing processes requiring the handling of a stack of parts of relatively soft flexible fabric material. In particular, the apparatus 10 is adapted for use in separating articles such as fabric parts used to form rear pockets on denim trousers. In this regard the apparatus 10 is interposed between a machine 21 which folds one edge of a pocket part 22 and sews a hem along the folded edge. The apparatus 21 includes a suitable feeding and folding mechanism, generally designated by the numeral 26 which feeds successive pocket parts 22 to a sewing machine 28 wherein the aforementioned hem is sewn by a double row of stitching, for example. The sewn or hemmed part is then ejected from the mechanism 26 and deposited on conveyor means such as a circular conveyor 30, for example. The transport rate of the conveyor 30 and the feed rate of the mechanism 26 are timed such that a somewhat staggered or shingled stack 32 of parts 22 is formed substantially continuously and wherein the hemmed edge of the part 22 previously formed protrudes in front of the hemmed edge of the next part deposited on the conveyor 30. The apparatus 21 may be similar to that disclosed and claimed in my U.S. Pat. No. 4,204,492 assigned to the assignee of this invention.

A second endless conveyor 34 is arranged to be fed either manually or automatically from one or a plurality of hemming machines 21 for feeding a substantially continuous supply of stacked fabric parts 22 towards the apparatus 10. The operation of transferring a stack of parts 22 from conveyor 30 to conveyor 34 may be done manually or mechanically. In so doing, the stack of parts may be inverted and a somewhat staggered inverted "shingled" stack 35 is provided on the conveyor 34. The apparatus 21 is merely exemplary as regards means for forming the shingled stack 32 in either the manner shown or after inversion to form stack 35. The conveyor 34 is arranged to feed a continuous shingled stack 35 of fabric parts 22 toward a second conveyor 38 which is preferably inclined so that as the stack traversing the conveyor 38 approaches the surface 14 the parts do not protrude substantially above the surface 14. The conveyors 34 and 38 are both preferably endless flexible belt type conveyors which are arranged relative to each other in such a way that the stack 35 is transferred directly to the conveyor 38 with the hemmed edges 32 of the parts 22 facing upwardly as will be shown and described further herein.

The arrangement illustrated in FIG. 1 further includes a sewing apparatus 40 which is arranged with respect to the surface 14 to receive individual separated fabric parts 22 which have been aligned and conveyed toward the apparatus 40 by conveyor or transport means 44 on the apparatus 10 which will also be described in further detail herein. The apparatus 40 includes a conveyor mechanism 42 aligned with the surface 14 and the conveyor means 44 to receive a plurality of parts 22 arranged spaced apart side-by-side and which are successively fed by the conveyor mechanism 42 to a sewing machine 46 forming a part of the apparatus 40 for performing additional sewing operations such as the sewing of a label or trademark on the parts 22. As mentioned above, the overall arrangement illustrated in FIG. 1 is primarily exemplary although the apparatus 10 is particularly suited for separating and feeding parts having a generally straight edge which may be formed by a hem such as the hem 32 and which may be brought in registration with means to maintain the parts 22 properly oriented with respect to the further conveyor mechanism 42.

Figure 2:
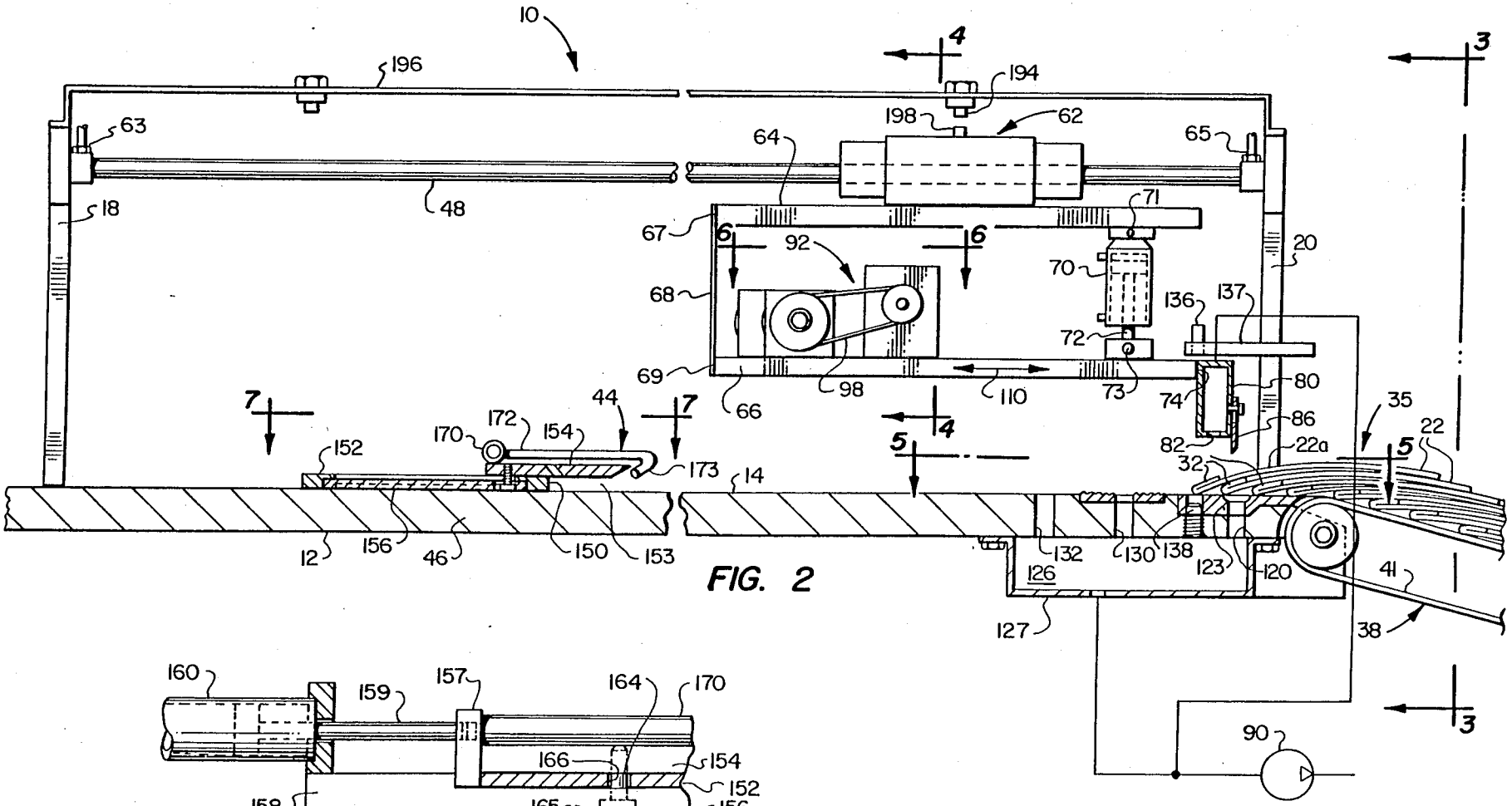
FIG. 2 is a longitudinal side elevation, partially sectioned, of the separating and feeding apparatus.
Figure 3:
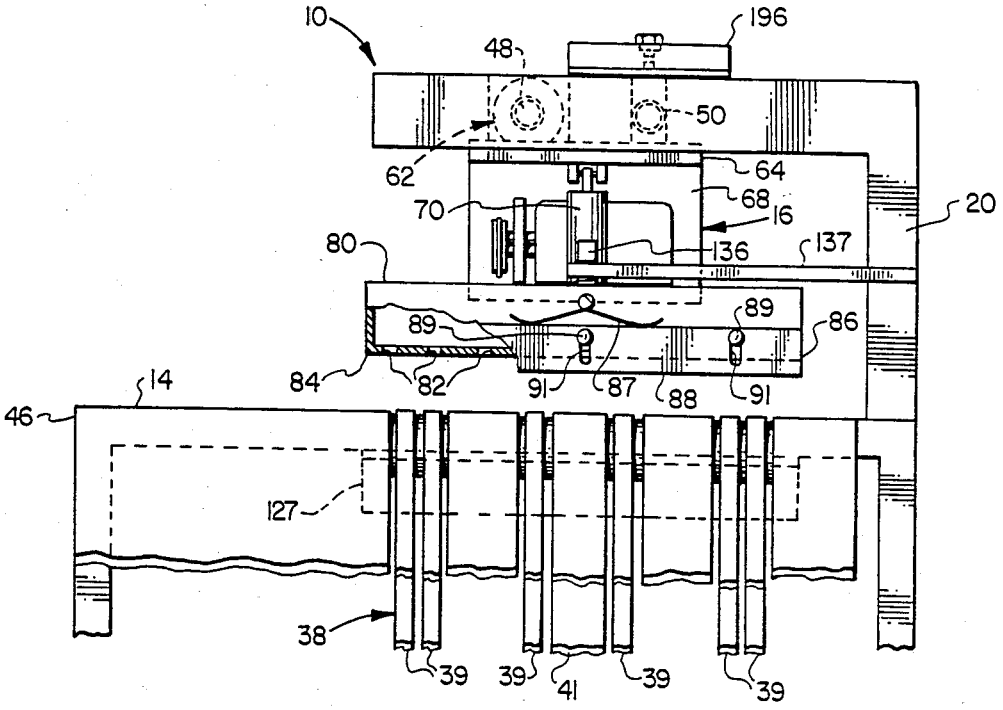
FIG. 3 is an end view taken from the line 3—3 of FIG. 2 but with the stack of fabric parts removed.
Figure 4:
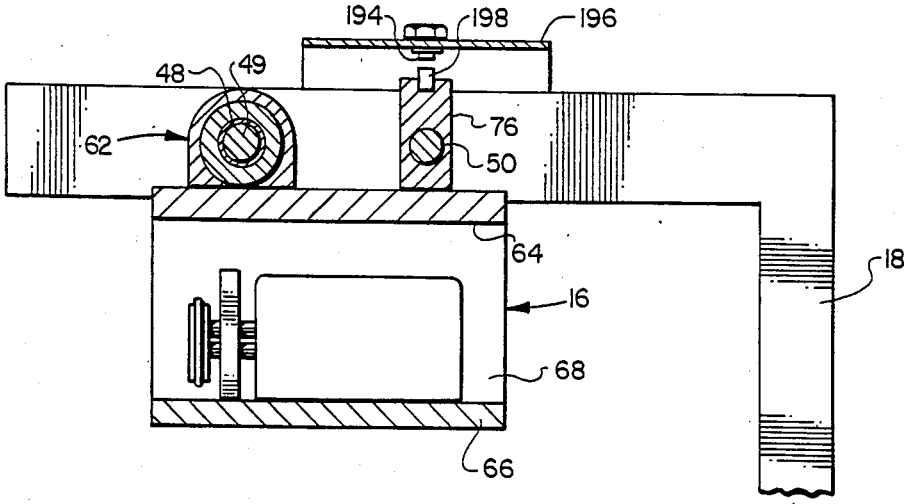
FIG. 4 is a detail section view taken along the line 4—4 of FIG. 2.

Referring now to FIGS. 2, 3 and 4, in particular, the surface 14 is formed on a generally flat plate member 46 of the frame 12. The plate 46 is adapted to be supported on suitable frame substructure, not shown. The carriage 16 is supported for linear traversal between the bracket members 18 and 20 on spaced apart elongated cylindrical bearing shafts 48 and 50, FIG. 4, which extend between and are secured to the brackets 18 and 20. The shaft 48 comprises parts of an actuator 62 characterized as a rodless linear cylinder type actuator. The shaft 48 is of a type which is hollow and is provided with a slidable piston 49, FIG. 4, which is reciprocated between opposite ends of the shaft 48 by the introduction of pressure fluid such as compressed air into the shaft through respective fittings 63 and 65, FIG. 2. The actuator 62 may comprise a so-called double acting rodless compressed air cylinder such as made by the Festo Corporation, Hauppauge, N.Y. Those skilled in the art will recognize that similar types of actuators may be used to reciprocate the carriage 16 between its limit positions.

Referring to FIG. 2, the carriage 16 further includes an upper support plate 64 secured to the actuator 62 and a lower support plate 6. The plates 64 and 66 are interconnected by a flexible member 68 which may be a relatively thin plate of spring steel suitably secured to the adjacent ends 67 and 69 of the respective plates 64 and 66. A double acting pneumatic cylinder and piston type actuator 70 is interconnected between the plates 64 and 66 and is operable to extend its piston rod 72 to depress the end 74 of the plate 66 downwardly toward the surface 14. The cylinder 70 is pivotally connected to plate 64 by a pivot pin 71 and piston rod 72 is pivotally connected to plate 66 by a pivot pin 73. As shown in FIG. 3, the plate 64 includes an upstanding bearing member 76 which is supported by the shaft 50 for sliding movement therealong.

Figure 2A:
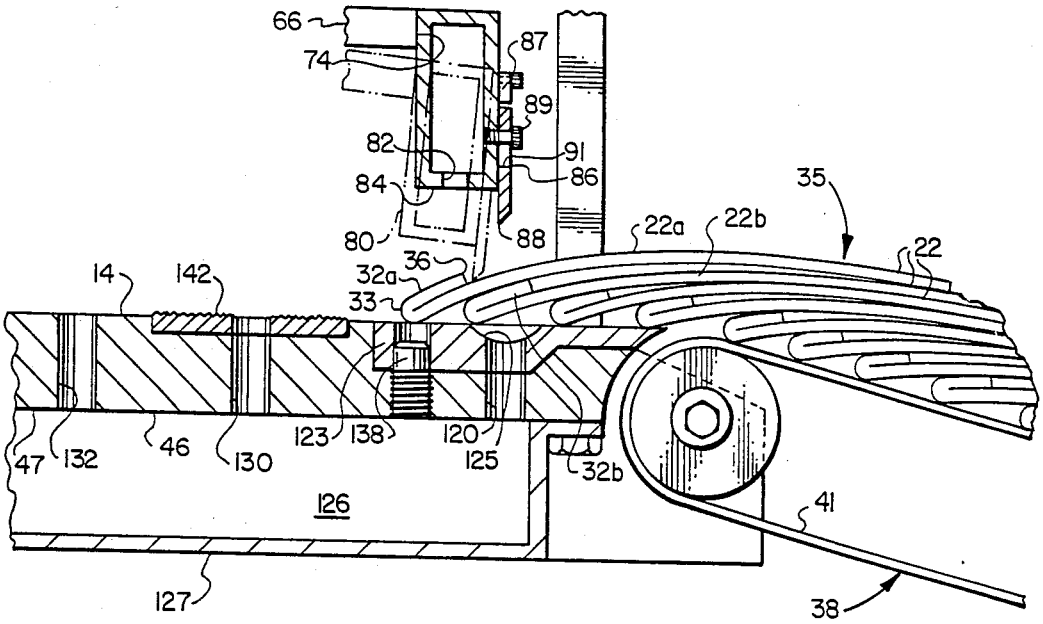
FIG. 2A is a detail view of a portion of FIG. 2 on a larger scale and taken generally along line 2A—2A of FIG. 5.

Referring to FIGS. 2, 2A and 3, an elongated manifold member 80 is secured to the plate 66 at its end 74 and has a plurality of spaced apart orifices 82 formed in a bottom wall 84. An elongated fabric part engaging bar 86 is secured to the manifold member 80 and projects downwardly below the wall 84 and forms a somewhat blunt knife edge 88. The bar 86 is preferably supported on the member 80 for limited relative movement under the urging of a spring 87, FIGS. 2A and 3, and is secured to the member 80 by fasteners 89 disposed in slots 91 which permit the bar to be yieldably biased downward toward engagement with a part to be separated from a stack. The manifold member 80 is connected to a vacuum source such as a vacuum pump 90, illustrated schematically in FIG. 2. In response to extension of the piston rod 72 of the actuator 70, the manifold 80 and bar 86 are lowered into engagement with a fabric part 22 which is presented in position directly below the manifold member in accordance with feeding the stack 35 toward a predetermined position on the surface 14 by the conveyor 38. Although the bar 86 is advantageous for engaging hemmed edges other part engaging means may be provided on the mainfold 80 such as downward projecting needles or other members which are operable to positively engage a fabric part.

Figure 6:
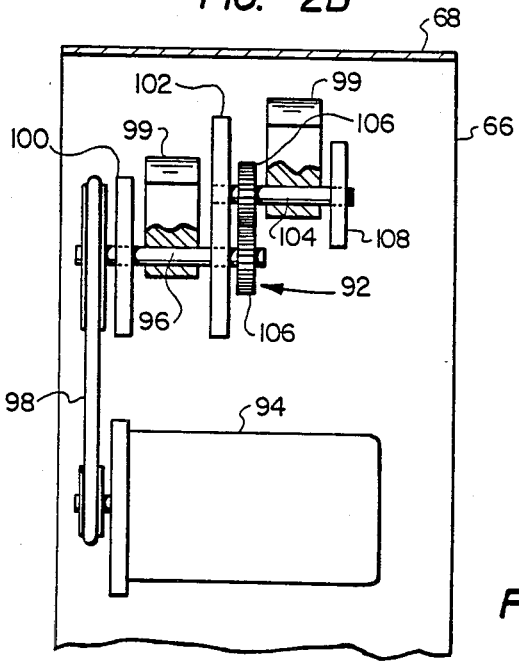
FIG. 6 is a detail plan view taken from the line 6—6 of FIG. 2.

Referring further to FIG. 2 and FIG. 6, the carriage 16 includes means for imparting vibratory motion to the plate 66 and the part engaging bar 86 comprising a vibrator mechanism 92. The vibrator 92 is of a type which is adapted to impart vibratory or oscillatory motion in a generally horizontal direction or longitudinally of plate 66 although it may be adjusted to cause oscillating vibratory motion in a vertical or inclined plane as well. The vibrator 92 comprises a motor 94 mounted on the plate 66 and drivably connected to a rotatable shaft 96 by a suitable belt and pulley drive arrangement 98. The shaft 96 is supported in spaced apart bearing supports 100 and 102 and is adapted to support an eccentric weight 99 for rotation therewith. The shaft 66 is also drivably connected to a second rotatable shaft 104 by intermeshing gears 106 keyed to the respective shafts 96 and 104, respectively. The shaft 104 is supported by the bearing support 102 and a second bearing support 108. The shaft 104 is drivably connected to a second eccentric weight 99 for rotation therewith.

The weights 99 are oriented with respect to each other such that in response to rotation of the shafts 96 and 104 in opposite directions and in timed relationship to each other the inertia forces exerted on the plate 66 by the rotation of the weights 99 provides for vibratory or oscillating motion in the direction of the double headed arrow 110, FIG. 2. The positional relationship of the weights 99 may, of course, be adjusted in accordance with the timing of the gears 106 so that the inertia forces exerted by the respective weight 99 oppose each other in the vertical direction as well as inclined directions and are in the same direction in the horizontal plane. Thanks to the flexible member 68 and the pivotal connections of the actuator 70 to the plates 64 and 66 the plate 66 is operable to vibrate or oscillate relative to plate 64 in a generally horizontal direction to assist in separating one of the parts 22 from an adjacent part on stack 35 upon engagement of the uppermost part 22*a*, viewing FIG. 2 or 2A. Although the vibrator 92 is particularly advantageous other vibrator mechanisms may be utilized to impart the desired motion to plate 66.

When the carriage 16 is in the position shown in FIG. 2 the actuator 70 may be energized to lower plate 66 to the position indicated by dashed lines in FIG. 2A whereby the bar 86 yieldably engages part 22*a* to be separated from stack 35. The impartation of a vibratory motion to the part 22*a* when engaged with the bar 86 has been determined to be a particularly advantageous feature in providing for the separation of the part engaged by the bar 86 without dragging the adjacent part 22*b* in the stack 35 with the part engaged by the bar. Suffice it to say for purposes of description herein that the vibrator 92 is adapted to impart longitudinal oscillatory motion to the plate 66 in accordance with the direction of the arrow 110. The amplitude of motion is, of course, dependent on the mass of the rotating weights 106, the speed of the vibrator mechanism and the stiffness of the spring steel connecting member 68 which permits longitudinal oscillation of the plate 66 with respect to the plate 64.

Figure 5:
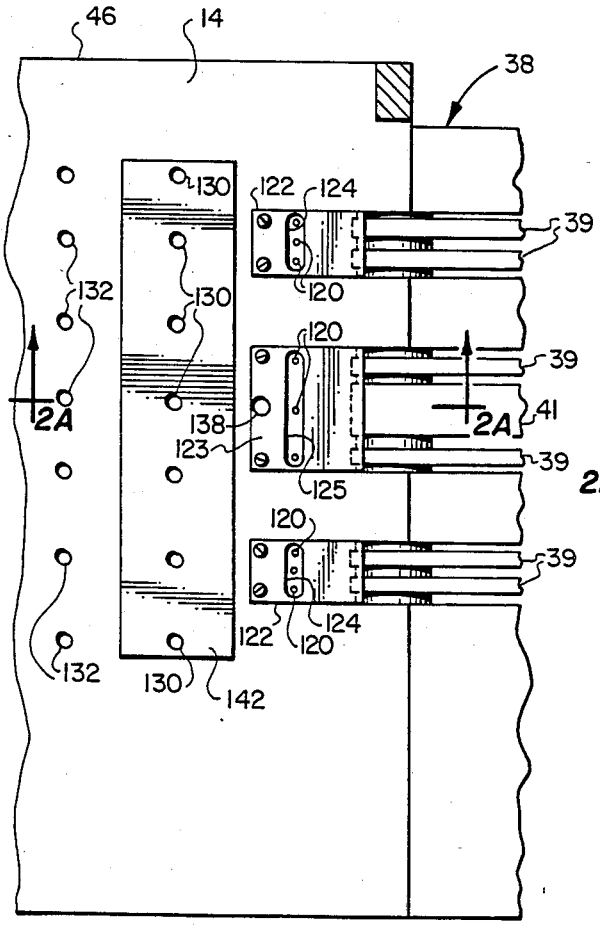
FIG. 5 is a detail plan view taken generally from the line 5—5 of FIG. 2.

Referring further to FIGS. 2, 2A and 5, the conveyor 38, which is typically made up of a plurality of spaced apart flexible endless belts 39 and 41, is oriented with respect to the surface 14 to present the shingled stack 35 to the surface so that the stack is in a substantially horizontal attitude as it approaches a position beneath the bar 86. A first row of spaced apart primary vacuum orifices 120 are formed in the plate 46 and extend through replaceable plate inserts 122 and 123. The inserts 122 and 123 include somewhat arcuate recesses 124 and 125 formed therein which increase the area of the orifices in the plane of surface 14 subject to the flow of air into a chamber 126 formed by a vacuum manifold member 127. The manifold member 127 is suitably attached to the bottom side 47 of the plate 46 and also forms a manifold for respective secondary and tertiary rows of orifices 130 and 132 parallel to the row of orifices 120 and spaced apart as shown in FIG. 5. The manifold 127 is also suitably connected to the vacuum pump 90 whereby air is drawn through the orifices 120, 130 and 132 from the surface 14 to assist in holding the fabric parts being separated and fed by the apparatus 10.

Referring to FIG. 2A, the stack 35 of fabric parts 22 is shown in position just prior to engagement of the part 22*a* by the bar 86 for separation from the stack and transport along the surface 14 to a reference surface for orienting the parts for subsequent conveyance to the apparatus 40, for example. The conveyor 38 is adapted for intermittent operation to feed the stack 35 into a position such that a part 22*a* to be separated and a part 22*b* next to be separated from stack 35 are oriented as indicated with respect to the orifices 120. The placement of the leading edge 33 of the hem 32 of part 22*a* is determined by a suitable position sensor such as a photoelectric cell 136, FIG. 2, mounted on an arm 137 secured to the bracket 20 above the insert member 123. A light source 138 is positioned in the insert 123 and is interrupted by the presence of the edge 33 of the part 22*a* to effect operation of a suitable control circuit, not shown, for arresting movement of the conveyor 38.

Whenever the position sensor 136, 138 senses the absence of a part 22, the conveyor 38 is activated to advance the stack 35 until the leading edge of a next to be separated part is in the position of the part 22*a* indicated in FIG. 2A. The precise location of the leading part 22 is not critical as long as the hem edge 36 is positioned with respect to the bar 86 so that the bar may engage the hem to positively separate the part 22*a*, for example, from the stack 35. The surface 14 may be provided with a relatively high friction surface strip 142 disposed along and parallel to the row of orifices 30 to prevent overfeeding the part 22*a* or slippage of the part upon arresting the motion of the conveyor 38.

When the first to be separated fabric part such as the part 22*a* is in position to be engaged by the bar 86, as indicated in FIG. 2A, the cylinder 70 is actuated to lower the plate 66 so that the bar 86 engages the surface of the part 22*a* and is positioned for forcible engage with the hem edge 36 upon movement of the actuator 62 to the left, viewing FIGS. 2 or 2A. In the operation of the apparatus 10, the vacuum pump 90 is substantially continuously operated to provide a vacuum pressure force acting on the second to be separated part 22*b*, FIG. 2A to hold that part and the remainder of the stack 35 in the position indicated in FIG. 2A as the part 22*a* is being separated. The orifices 82 are effective to assist in engaging the part 22*a* and lifting the hem 32 slightly to lift the leading edge portion of the part 22*a* away from the part 22*b*. Of course, the vibrator mechanism 92 is operating to oscillate the plate 66 and bar 86 in a generally horizontal direction commensurate with the engagement of the part 22*a* by the bar 86.

Figure 2B:
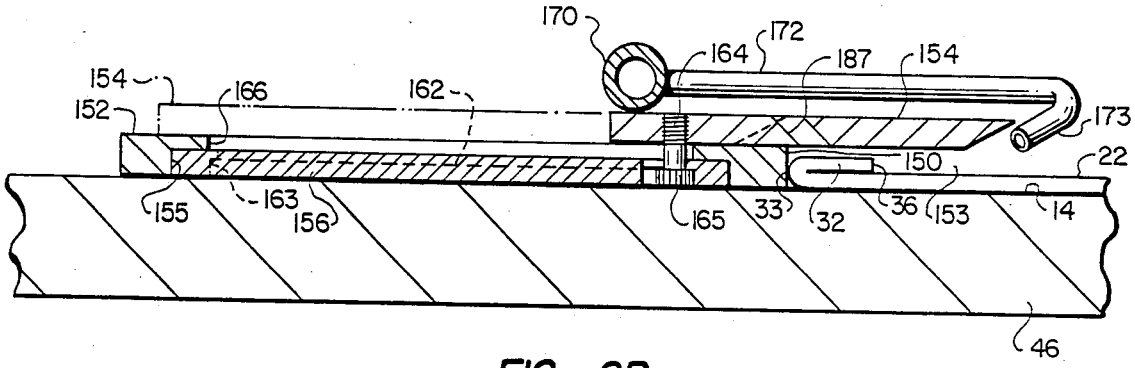
FIG. 2B is a detail view of another portion of FIG. 2 on a larger scale and taken generally along line 2B—2B of FIG. 7.

Upon lowering the plate 66 to cause engagement of the bar 86 with the part 22*a*, for example, the actuator 62 is operated to translate the carriage 16 to the left, viewing FIGS. 2 and 2A, to separate the part 22*a* from the stack 35 and transfer the part along the surface 14 to a reference surface, generally designated by the numeral 150 in FIGS. 2 and 2B. The surface 150 is formed on a plate member 152 which extends substantially perpendicular to the path of reciprocation of the carriage 16 and has mounted thereon a retractable shield member 154 which is operate to form a guide channel or enclosure 153 for guiding the parts 22 as they are separated from the stack 35 and fed seriatim into registration with the surface 150.

Figure 7:
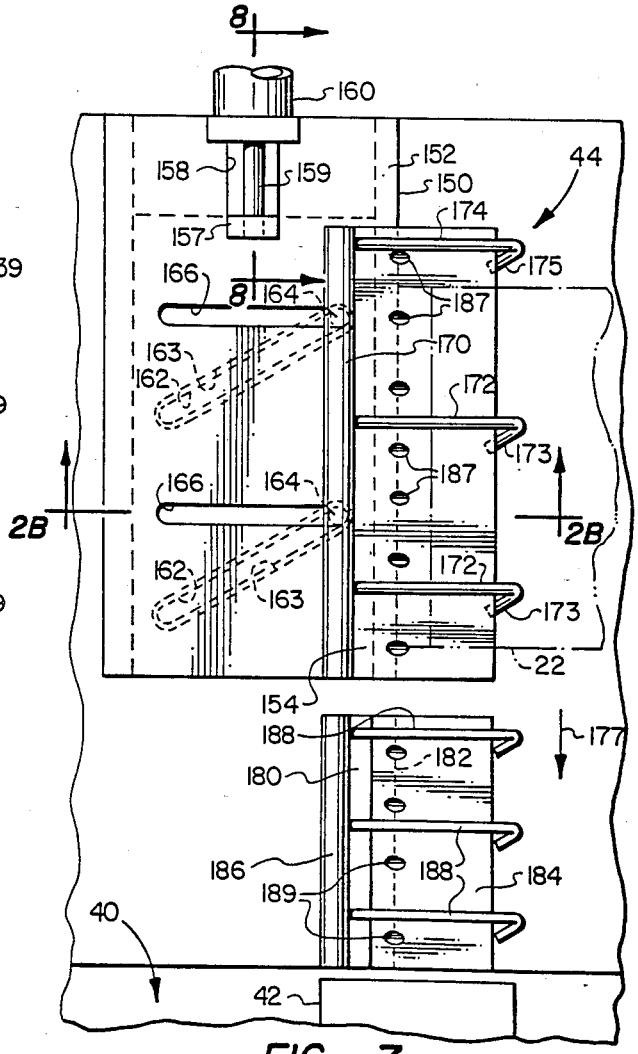
FIG. 7 is a detail plan view taken from the line 7—7 of FIG. 2.
Figure 8:
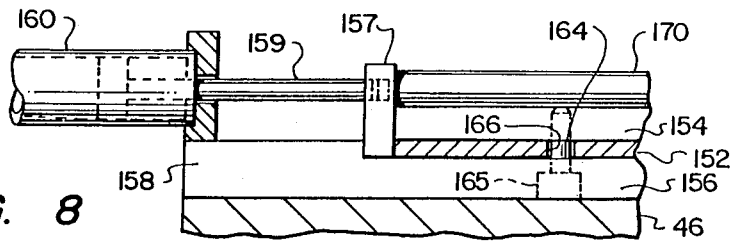
FIG. 8 is a detail section view taken from line 8—8 of FIG. 7.

Referring to FIGS. 2, 2B and 7, the plate 152 has a longitudinal channel shaped recess 155 formed therein for receiving and guiding a reciprocable cam plate 156. As shown in FIGS. 7 and 8 the cam plate 156 includes an upstanding boss 157 which extends through a slot 158 in the plate 152 and is connected to the piston rod 159 of a double acting pneumatic cylinder actuator 160. As shown in FIG. 7 the cam plate 156 has two spaced apart elongated cam slots 162 formed therein which receive cam followers 164 comprising generally cylindrical threaded pins having a head portion 165, FIG. 2B. The cam followers 164 also extend through slots 166 formed in the plate 152 and are connected to the shield member 154 as shown by way of example in FIG. 2B. The cam followers 164 are retained in the slots 162 by the head portions 165 which engage a shoulder formed by recessed portions 163 of the cam slots 162, respectively. In response to movement of the piston rod 159 upward, viewing FIG. 7, the cam plate 156 is moved to cause the cam follows 164 to translate linearly to the left, viewing FIGS. 7 and 2B, in the slots 166 to retract the shield 154 to the alternate position indicated by the dashed lines in FIG. 2B. In response to movement of the piston rod 159 in the opposite direction or downward, viewing FIG. 7, the cam plate 154 and the cam followers 164 are operable to position the shield 154 in the original position described in conjunction with FIG. 2B.

Referring further to FIG. 7, the shield 154 comprises part of the conveyor means 44 for conveying the parts 22 along the guide surface 150 to be engaged by the conveyor 42 on the apparatus 40 or subsequent conveyor means for other operations, depending on the configuration of the parts being separated and fed or transferred by the apparatus 10. The shield member 154 includes a pressure air manifold member 170 mounted thereon and connected to a plurality of elongated conduits 172, and 174 the distal ends of which include jet nozzles 173 and 175, respectively. The nozzles 173 are oriented to impart a pressure air jet force on a part 22 to hold the part in engagement with the surface 150 but to also translate the part downward, viewing FIG. 7, in the direction of the arrow 177. The nozzle 175 is positioned such that a jet of air is imparted downward toward the surface 14 adjacent a side edge of a part 22 to slightly lift or float the part 22 on the surface 14 when it is in registration with the surface 150 to assist in conveying the part in the direction of the arrow 177.

As shown in FIG. 7, the apparatus 10 includes secondary conveyor means including a member 180 forming a surface 182 aligned with the surface 150 for receiving a part 22 conveyed by the jet nozzles 173 and 175 in the direction of the arrow 177. A secondary shield 184 is mounted fixed on the member 182 and a manifold 186 is supported on member 182 and provided with pressure air jet nozzles 188 which are oriented to continue the feeding of the parts 22 as they are transferred along the surfaces 150 and 182. The shield members 154 and 184 are provided with air bleed ports 187 and 189, respectively, to prevent the build up of pressure in the enclosures or channels such as the channel 153, FIG. 2B, to facilitate the ease with which the parts 22 may be fed along the guide surfaces 150 and 182. Although the conveyor means 44 provided by the movable shield 154, the fixed shield 184 and the nozzles 173, 175 and 188 provides a reliable and mechanically uncomplicated means for conveying the separated parts 22 seriatim along the apparatus 10 to a succeeding operation those skilled in the art will recognize that other forms of conveyors may be used to transfer the parts 22 laterally along the path indicated by the arrow 177 to further conveyor means or to another operating station.

The general operation of the apparatus 10 to substantially continuously separate parts 22 from a stack 35 and feed the parts into registration with the surface 150 and then laterally along the surfaces 150 and 182 will now be described. As mentioned previously, the conveyor 38 may be operated independently of the actuators 62, 70 and 160 as well as operation of the vibrator mechanism 92. The conveyor 38 is responsive to sensing the absence of a part 22 generally aligned with the position sensor 136, 138 to feed the stack 35 into position such that a hem edge 36 of a part 22, such as part **22*a*, or at least a sufficient portion of a part 22 is in position to be engaged by the bar 86 and the second to be dispensed or separated part, such as the part 22*b*, is disposed over the recesses 124 and 125 to be held by the pressure force acting downward on the hem 32*b* of the part 22*b*, for example. Once a part 22 has been separated from the stack 35 and fed toward the surface 150, the position sensor 136, 138 senses the absence of a part and the stack 35 is advanced accordingly. Moreover, with the independent operation of the conveyor 38 any gaps in the stack 35 caused by upstream interruptions in production or flow of material will rapidly be compensated for by continued feeding or conveyance of the stack until a leading edge 33 of a part presents itself at the position sensor 136, 138. As mentioned previously if the inertia of the conveyor 38 or some other factor should cause slippage of a part 22 the friction surface 142** will arrest the part to be fed next by the apparatus just slightly beyond its normal separation position.

For simplicity of control and operation of the apparatus 10 the vacuum pump 90 is typically continuously operated to create a pressure differential at the wall 84 and on the surface 14 in proximity to the orifices 82, 120, 130 and 132, respectively.

In an operating cycle of the apparatus 10, it will be assumed that the actuator 62 has positioned the carriage 16 in the position shown in FIG. 2. Proximity sensors 192 and 194 are preferably provided on a support member 196 for sensing the position of the actuator 62 and, in particular, a signal generating member 198 mounted on top of the bearing member 76, FIG. 4. Accordingly, when the actuator 62 is in the position shown in FIG. 2 and a signal from the position sensor 194 is read along with a signal from the position sensor 136, 138, indicating the proper position of a part **22*a* to be engaged by the separator mechanism, the actuator 70 is energized to lower the distal end 74 of the plate 66 to cause engagement of the bar 86 with part 22*a*. Concomitant with or just prior to actuation of the actuator 70 to extend its piston rod 72, the motor 94 may be energized to commence operation of the vibrator mechanism 92 to oscillate the plate 66 longitudinally in the general direction of the double headed arrow 110 in an oscillatory motion to assist in separating the part 22*a* engaged by the bar 86 from the part 22*b* which is contiguous with the stack 35. The amplitude and rate of vibration of the plate 66** may be adjusted in accordance with the materials and surface finish of the parts being separated.

Following energization of the actuator 70, as described, and with a suitable time delay, the actuator 62 is energized to translate the carriage 16 to the left, viewing FIGS. 2 and 2B, whereupon the bar 86 will forcibly engage the hem edge 36 to pull the part **22*a*, for example, away from the stack 35. Thanks to the vacuum induced force acting on the part 22*b* and the friction between part 22*b* and the stack 35, this part will be retained on the stack 35. As the carriage 62 translates the part 22*a* along the surface 14 and it passes over the orifices 130 and 132 the part is smoothed out and retained flush on the surface 14 to permit the bar 86 to firmly engage the hem edge 36 and orient the part relative to the bar 86 if the part was slightly skewed on the stack 35. The actuator 62 then transfers the part separated from the stack 35 toward registration with the surface 150. When the carriage 16 leaves its position in proximity to the position sensor 194, the actuator 152 is energized to move the shield 154 to its retracted position, indicated by the alternate position lines in FIG. 2B, to be clear of the manifold member 80 and the bar 86 as the edge 33 of the part 22 approaches the surface 150. As the actuator 62 moves to the position to engage the edge 33 with the surface 150 the position sensor 192 detects the position of the carriage 16 and effects deenergization of the actuator 62, the motor 94 and energizes the actuator 70 to retract the distal end 74 of the plate 66 upward into the position relative to plate 64 shown in FIG. 2. During movement of the carriage 16 to the left, viewing FIG. 2, the conveyor 38 is operated to advance the stack 35 to place the next to be separated part in position for engagement by the bar 86 during the succeeding operating cycle of the carriage 16**.

After deenergization of the motor 94 and retraction of the plate 66, the actuator 62 is energized to return the carriage 16 to the position indicated in FIG. 2. Upon energization of the actuator 62 to return to the FIG. 2 position, the actuator 152 is energized in timed relationship to energization of the actuator 62 to move the shield 154 into the position indicated by the solid lines in FIG. 2B. Upon movement of the shield 154 into the position shown in FIGS. 2B and 7 pressure air is jetted through the nozzles 173 and 175 to convey a part 22 downward, viewing FIG. 7, where it is further conveyed by the pressure jetting forces acting on the part due to the nozzles 188. The nozzles 188 may be operated in timed relationship to further conveying means such as the conveyor 42 and the actuation of the carriage 16 to separate and convey the next part from the stack 35 may also be controlled in accordance with the proper feeding of parts in series along the surface 150 to maintain a suitable spacing between the parts and to prevent over running one part with another.

As the carriage 62 returns to the FIG. 2 position and its position is sensed by the position sensor 194, if a part 22 is in position to be engaged by the bar 86 the actuator 70 and the motor 94 are again energized to engage and vibrate a part 22 with the bar 86 followed by energization of the actuator 62 to separate the next part from the stack 35 and repeat the above-described operating cycle.

Figure 9:
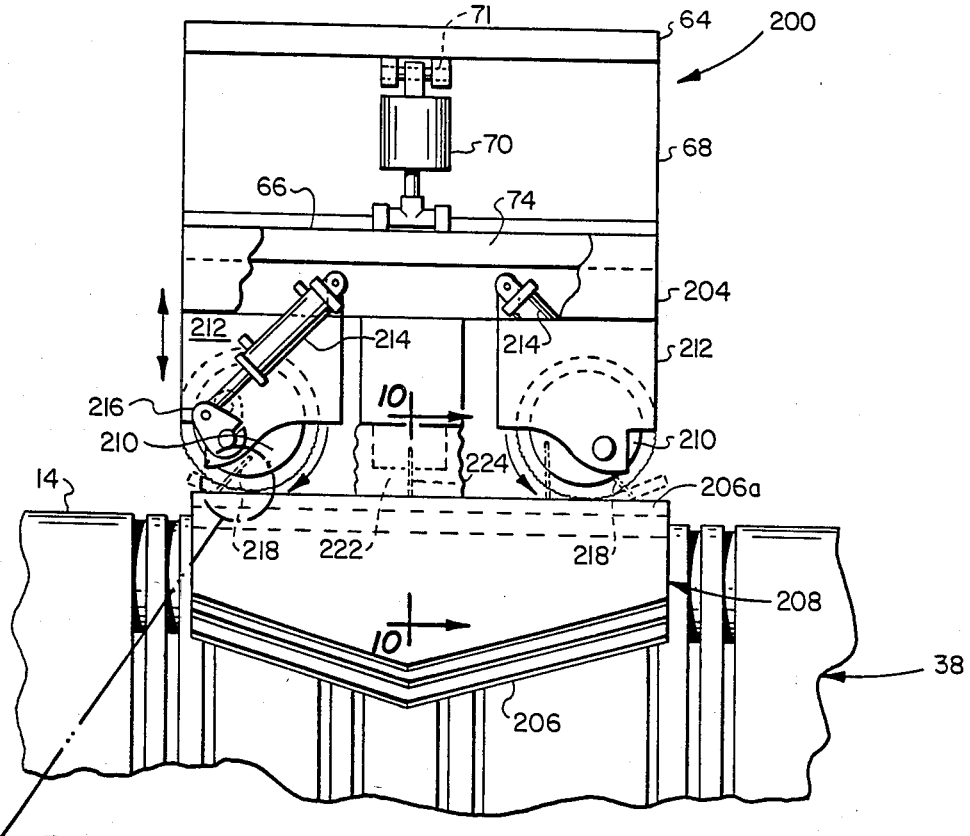
FIG. 9 is a partial elevation taken generally from the same line as FIG. 3 and illustrating an alternate embodiment of the separating mechanism for the apparatus of the present invention.
Figure 9A:
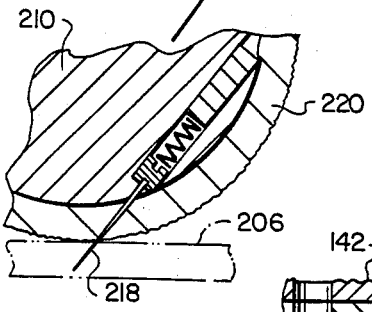
FIG. 9A is a detail view of a portion of the mechanism shown in FIG. 9.
Figure 10:
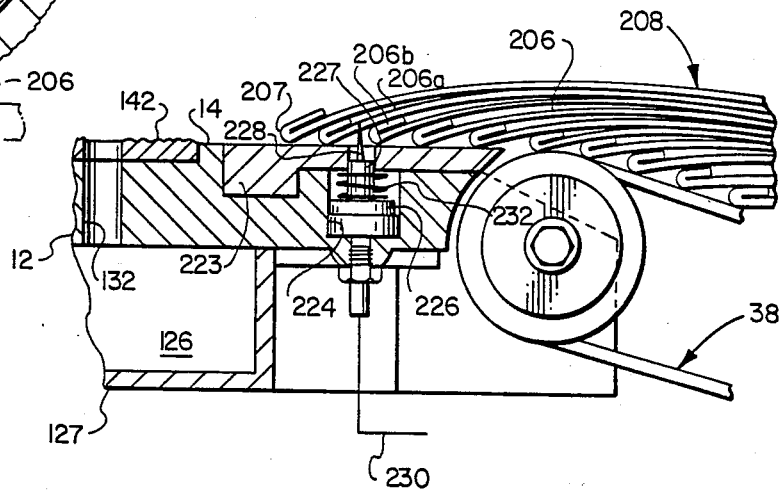
FIG. 10 is a detail section view taken along the line 10—10 of FIG. 9.

Referring now to FIGS. 9, 9A and 10, a modification of the apparatus 10 with regard to the mechanism for positively engaging the stack of parts will be described. FIG. 9 illustrates a modification of the apparatus 10, generally designated by the numeral 200 and comprising essentially all of the components of the apparatus 10 including the conveyor 38 but also including a modified carriage, generally designated by the numeral 202. The carriage 202 is similar to the carriage 16 except that the manifold member 80 has been removed from the distal end 74 of plate 66 and a support member 204 mounted thereon. The support member 204 comprises part of a mechanism for engaging and separating a fabric part 206 from a stack of fabric parts 208 similar to the stack 35 with the exception that the parts 206 do not have a hemmed leading edge. The parts 206 are provided with edges 207 which present themselves on the surface 14 and are arranged in a shingled or staggered configuration in the same manner as the parts 22 are arranged in the stack 35.

The separating mechanism disposed on the carriage 202 is similar to that described in my U.S. Pat. No. 4,143,871 also assigned to the assignee of the present invention. The support member 204 is adapted to support a pair of opposed cylindrical part engaging members 210 which are rotatably mounted on the support member 204 on suitable opposed spaced apart brackets 212. Each of the members 210 are operably connected to an actuator 214 having a crank arm 216, one shown, connected to the members 210 for rotating the members in opposite directions to positively engage a part 206 to be separated from the stack 208 by opposed fabric engaging needles 218, see FIG. 9A, for example. The needles 218 are suitably supported on the members 210 and extend generally radially outward through a foam rubber outer shell portion 220. The support member 204 may also be provided with a part engaging member 222 centered between the cylinder members 210 and including a third needle or knife edge 224 which engages the uppermost part **206*a* in the stack 208 while the cylinder members 210 are being rotated to engage the part to be separated and tension the part so that it may be lifted or separated from the stack 208**.

The cylinder members 210 are mounted eccentrically with respect to their longitudinal axes on the brackets 212 and, in response to energization of the actuators 214 may be rotated into a position wherein the needles 218 positively engage opposite sides of a fabric part **206*a* and tend to lift the opposite sides of the part into the alternate position illustrated in FIG. 9 whereby the part is positively engaged and ready to be separated from the stack in response to linear reciprocation of the carriage 202. The carriage 202 includes the support plate 64, the flexible plate 68 interconnecting plates 64 and 66, and the actuator 70 for raising and lowering the plates 66 so that the cylinder members 210 may engage the fabric part to be separated from the stack 208. The alternate embodiment of a part engaging and separating mechanism as illustrated in FIGS. 9 and 9A may be better suited to separating parts without hemmed edges such as the parts 206**.

Referring also to FIG. 10, the apparatus 200 is further modified with regard to the provision of means for positively engaging and holding back the next to be separated part, such as the part **206*b* shown by way of example in FIG. 10. The plate 12 is adapted to include one or more cylinder bores 224 in which are disposed reciprocable pressure fluid responsive pistons 226 having a rod portion 227 with a needle point 228 disposed on its distal end and projecting upward from the surface 14 in response to the introduction of pressure air into the cylinder bore 224 through a supply conduit 230. A coil spring 232 is operable to bias the piston 226 into a retracted position wherein the needle point 228 is flush with or disposed below the surface 14. The plate 12 is provided with one or more modified inserts 223 similar to the insert 123 and closing one end of the cylinder bore 224 but providing a suitable bore for accommodating the piston rod 227 for reciprocating motion between the extended and retracted positions. The apparatus 200 can, of course, include a plurality of orifices, not shown, similar to the orifices 120 whereby the parts 206 may be held back by both a vacuum induced force as well as being positively engaged with one or more pressure fluid actuated needle points 228**.

Pressure fluid is suitably introduced into and exhausted from the bore 224 to effect actuation of the piston 226 in timed relationship with the operation of the conveyor 38 and/or the cylinder actuator 70. For example, upon feeding the stack 208 into the position shown in FIG. 10, the cylinder actuator 70 and the piston 226 may be energized simultaneously to lower the plate 66 and extend the needle point 228 into engagement with the part 206*b*. As soon as the plate 66 is extended to its lowered position the cylinder elements 210 may be rotated to cause the needles 218 to engage part 206*a* prior to transport of the carriage 202 linearly along its support. With the arrangement illustrated in FIGS. 9 and 9A, the cylinder 70 may actually be retracted somewhat to assist in lifting the part 206*a* slightly away from the surface 14 in addition to transporting the part to the left, viewing FIG. 10, away from part 206*b* and the stack 208. The hold back cylinder actuator comprising the bore 224 and piston 226 may be deenergized once the part 206*a* is separated from the stack 208 so that the stack may be advanced to position the next part for separation from the stack. Those skilled in the art will recognize that other mechanisms for separating the parts from a shingled stack may be utilized including a conveyor type separator similar to that disclosed in my U.S. Pat. No. 4,203,590 assigned to the assignee of the present invention.

Figure 12:
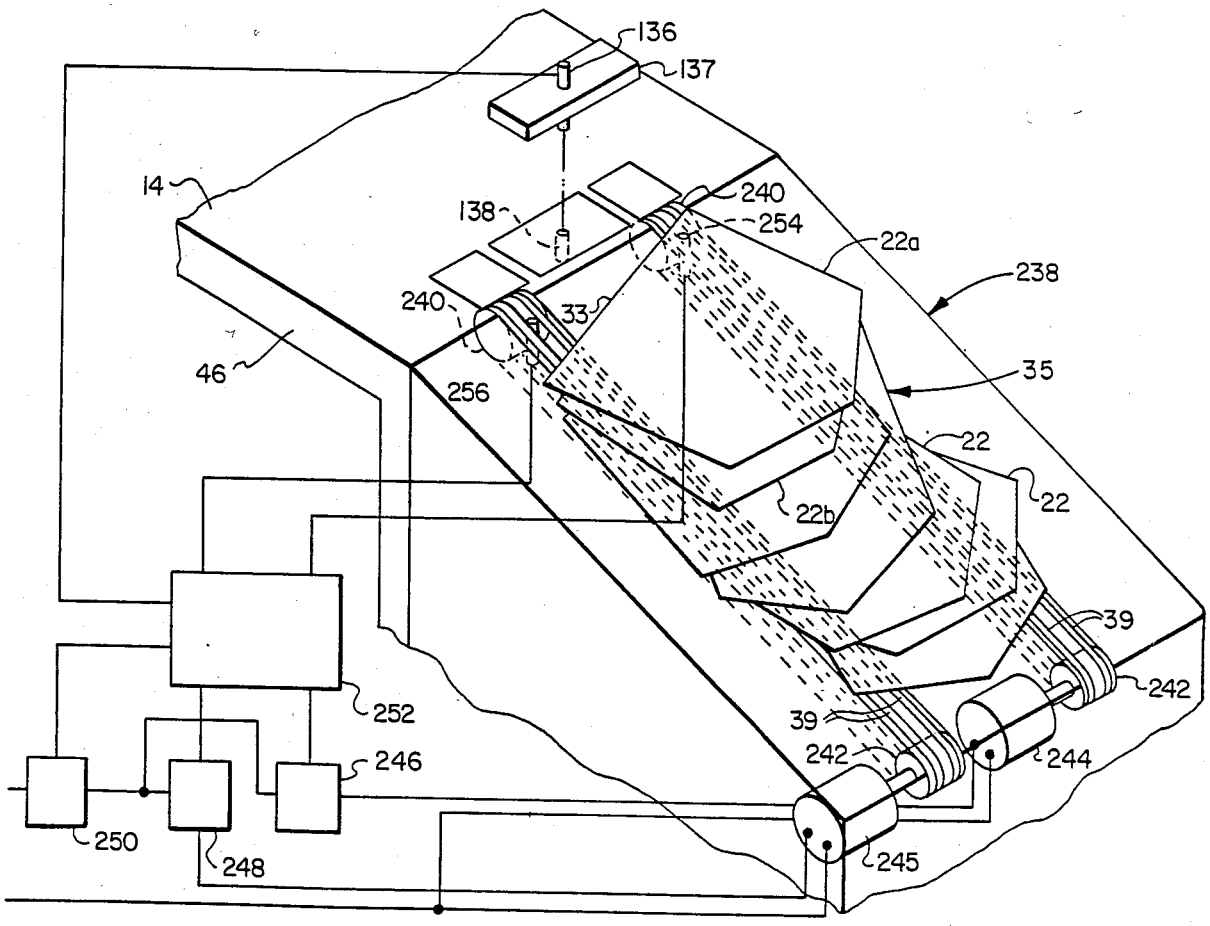
FIG. 12 is a somewhat schematic diagram of an arrangement for aligning an edge of each part of the stack prior to separation.

Referring now to FIG. 12, there is illustrated a modification of the inclined conveyor, generally designated by the numeral 238, for conveying a shingled stack 35 toward the support surface 14 of the plate 46. The conveyor 238 includes two sets of spaced apart conveyor belts 39 which are trained around spaced apart pulleys 240 supported on the plate 46 and pulleys 242 suitably supported on a frame 239 of the conveyor 238. The pulleys 242 are each drivenly connected to suitable electric motors 244 and 245 which are suitably electrically connected to a source of electric energy through switches 246 and 248, respectively, and a master switch 250. The switches 246 and 248 are adapted to be controlled by a control circuit 252 which includes photoelectric sensor elements 254 and 256 which are positioned with respect to the belts 39 of each of the separate conveyor belt arrangements such that they are aligned with each other along a line generally perpendicular to the direction of movement of the belts 39.

The sensors 254 and 256 are operable to detect the presence of a leading edge 33 of a fabric part 22*a* on top of the stack 35 and, accordingly, positioned to be next separated from the stack. The orientation of the edges 33 of each of the parts 22*a* and 22*b* may be such that, upon engagement of the part to be separated from the stack by the separating mechanisms described herein, the leading edge of the part may remain skewed with respect to the direction of travel of the part and thereby be improperly gripped or engaged by the separating mechanism which would tend to foul the operation of the separating and feeding apparatus. In accordance with the present invention it is contemplated that the sensors 254 and 256 may operate the switches 246 and 248 through the control circuit 252 to effect operation of the motors 244 and 245 independently of each other whereby the stack 35 may be oriented to position the leading edge 33 generally perpendicular to the line of travel of the stack 35 as it approaches the position on the support surface 14 wherein it is arrested further movement such as in response to a signal from the sensor 136–138 indicating that the part to be separated has reached the predetermined position on the surface 14.

The control system illustrated in FIG. 12 is preferably arranged to be operable as follows. When the sensor 136–138 senses the absence of a part 22 in position for engagement by the separating mechanism the switch 250 may be actuated to energize both motors 244 and 245 to advance the stack 35 toward the surface 14. If either of the sensors 254 or 256 senses the presence of the edge 33 of the leading part 22*a* of stack 35, the motor associated with that sensor will be deenergized through its associated switch while the other motor is allowed to continue operating to drive the conveyor belts 39 connected thereto until the other sensor detects the presence of the leading edge 33 whereby both motors will be energized to advance the stack toward surface 14. In this way the stack will be oriented such that the leading edge 33 of a part 22 will be turned to align the edge generally perpendicular to the intended direction of travel of the stack as provided by the conveyor 238. Once both sensors have indicated the presence of the edge 33 aligned with that sensor the switches 246 and 248 may both be closed thereby advancing the stack until the sensor 136 effects deenergization of the switch 250 to shutoff both motors 244 and 245 and arresting the stack 35 in position for separation of part 22*a* from the stack. Alternatively, the sensors 254 and 256 may be positioned relative to the surface 14 such that the sensors 136 and 138 may be omitted and the conveyor belt drive motors 244 and 245 operated until the leading edge of each part, as the stack 35 is advanced, is oriented by driving either one set of belts 39 or the other to square the edge 33 with the surface 14 and to arrest movement of the stack once the orientation of the leading edge of a part is in its predetermined position.

Figure 11:
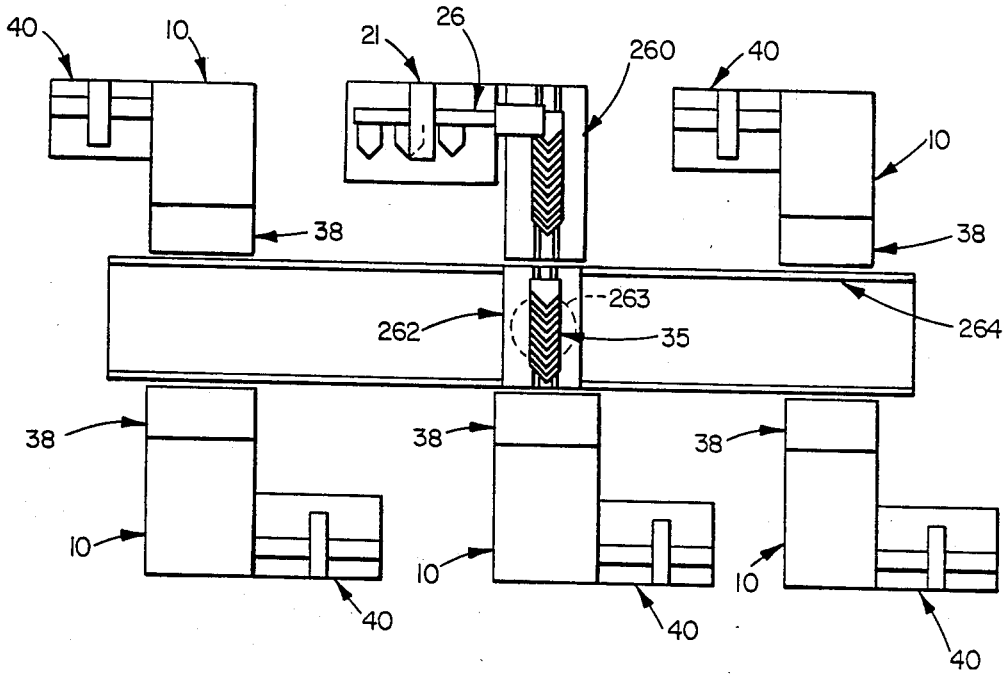
FIG. 11 is a schematic plan view of a system utilizing the apparatus and method of the present invention.

Referring now to FIG. 11, it is comtemplated that a plurality of separating and feeding apparatus 10 may be arranged in conjunction with, for example, a hemming machine 21 which would feed a linear conveyor 260. The conveyor 260 is operable to supply a shingled stack 35 to a conveyor 262 similar to the conveyor 34 but mounted on suitable means for traversing a trackway 264 whereby a plurality of separating and feeding apparatus 10 are operable to receive stacks 35 of predetermined length on their respective feed conveyors 38. As indicated in FIG. 11 each separator and feeder apparatus 10 may be associated with an apparatus 40 for performing further operations on the fabric parts supplied by the machine 21.

In the arrangement shown in FIG. 11 conveyors 38, separator and feeder apparatus 10, and machines 40 are disposed on opposite sides of the trackway 264. Accordingly, the conveyor 262 is preferably provided with a turntable substructure 263 for rotating the conveyor so that the same leading edge of each of the fabric parts in a stack is presented to all of the separator and feeder apparatus 10 in the same manner as described in conjunction with the arrangement of FIG. 1. The parts making up the stacks 35 may or may not require inversion before being loaded on the conveyor 262 depending on whether or not the hem edge 84 of each fabric part 22 is turned upward or downward during the hemming operation performed by the machines 21.

In the arrangement of FIG. 11, the operation of the conveyor 260 would be controlled to load the conveyor 262 only when it is present at the conveyor 260 as illustrated. Once the conveyor 262 has moved along the trackway 264 to one or more stations at which an apparatus 10 and a conveyor 38 is disposed, the conveyor 260 would shut down if a stack 35 approached the end of the conveyor normally adjacent to conveyor 262. The relative sizes of the conveyors 260 and 262 could, of course, be adjusted to provide for timed loading of the conveyors 262 and transport of the conveyor 262 to one or more of the conveyors 38, unloading of the conveyor 262 and return to the station for receiving additional stacks 35 from conveyor 260 so that a substantially continuous feeding of a respective apparatus 10 may be obtained.

Those skilled in the art will appreciate from the foregoing description that a particularly unique method and apparatus for separating and feeding or transferring fabric parts has been provided in accordance with the present invention. The provision of a staggered or shingled stack presented to an automatic feeder mechanism provides for more reliable and easy separation of fabric parts. This reliable and easy separation and feeding is further enhanced by utilizing a hem edge or other structural portion of the fabric part to be positively engaged by the separating and feeding mechanism. The invention also contemplates the use of the aforementioned hem edge to provide positive registration or positioning of a part during the separating and feeding cycle. The overall arrangement of utilizing a vibratory feeder in accordance with the present invention together with retention of the second to be fed part by a vacuum induced or mechanical force provides a particularly unique separating and feeding mechanism. Moreover, the conveyance of fabric parts along a reference or guide surface utilizing pressure air jet conveyor means in combination with the other aspects of the invention also provides a particularly uncomplicated and reliable system.

Although preferred embodiments of an apparatus for separating and feeding fabric parts have been described herein in conjunction with the drawing those skilled in the art will recognize that various substitutions and modifications may be made to the specific structure and methods described without departing from the scope and spirit of the invention as recited in the appended claims.

What I claim is:

1. Apparatus for separating apparel parts from a shingled stack of said parts and feeding said separated parts seriatim to a predetermined destination, comprising:

means forming a support surface for supporting at least a portion of said stack including the first part to be separated from the top of said stack overlying the second part next to be separated from said stack;

conveyor means for feeding said stack to a predetermined position on said surface;

holddown means in the proximity of said position acting on the second part to be separated from said stack for holding said second part against being displaced during displacement of said first part; and means operable for mechanically engaging said first part and moving said first part away from said stack to said destination concomitantly with the acting of said holddown means on said second part.

2. The apparatus set forth in claim 1 wherein:

said means for engaging said first part includes a member mechanically engageable with said first part and vibrator means for vibrating said member during engagement of said first part to reduce frictional resistance to separation of said first part from said second part.

3. The apparatus set forth in claim 1 including:

vacuum producing means on said means for engaging said first part for producing a fluid pressure force acting on at least a portion of said first part to assist in separating said first part from said second part.

4. The apparatus set forth in claim 1 including:

means for sensing the absence of an edge of said first part at said predetermined position on said surface for effecting operation of said conveyor means to move said stack to a position wherein an edge of a part to be next separated from said stack is disposed at said predetermined position.

5. The apparatus set forth in claim 1 wherein:

said parts each include an edge generally aligned with a corresponding edge on the other parts in said stack, said stack is conveyed to said surface in such a way that said edges of said parts are spaced apart one from the other and are engageable with said surface as said stack is advanced by said conveyor means, and said member is engageable with said first part at a point adjacent to said edge for separating said first part from said stack.

6. The apparatus set forth in claim 5 wherein:

said edges of said parts are formed by a hem, said hems each forming a hem edge for positive interlocking engagement with said member.

7. The apparatus set forth in claim 1 wherein:

said holddown means includes orifice means opening to said surface for producing a vacuum induced fluid pressure force acting on said second part to be separated.

8. The apparatus set forth in claim 1 wherein:

said holddown means includes means for positively engaging and disengaging from said second part to be separated.

9. Apparatus for separating apparel parts from a shingled stack of said parts and feeding said separated parts seriatim to a predetermind destination,, comprising:

means forming a support surface for supporting at least a portion of said stack including the first part to be separated from said stack;

conveyor means for feeding said stack to a predetermined position on said surface;

holddown means acting on the second part to be separated from said stack for holding said second part;

means including a member engageable with said first part for moving said first part away from said stack to said destination said member being supported on carriage means including a first support plate, a second support plate, means interconnecting said plates and providing for movement of said second support plate relative to said first support plate, and actuator means for moving said second support plate and said member between positions for engagement with and disengagement from said parts to be separated from said stack; and vibrator means for vibrating said member during engagement of said first part to reduce frictional resistance to separation of said first part from said second part.

10. The apparatus set forth in claim 9 wherein:

said vibrator means is mounted on said second support plate for vibrating said second support plate and said member.

11. The apparatus set forth in claim 9 wherein:

said carriage means is movable relative to said surface for transferring said parts seriatim to registration of an edge of each of said parts with a guide surface, and said apparatus includes means for conveying said parts along said guide surface to said destination.

12. The apparatus set forth in claim 11 including:
guide means associated with said guide surface and forming a guide channel for an edge of said part registered with said guide surface.

13. The apparatus set forth in claim 12 wherein:
said guide means is movable relative to said guide surface between a retracted position and a position forming said channel in response to movement of said carriage means.

14. The apparatus set forth in claim 11 wherein:
said means for conveying said parts along said guide surface comprises air jet nozzle means for providing a jet of pressure air directed so as to maintain said edge of said part engaged with said guide surface and to propel said part along said guide surface.

15. Apparatus for separating apparel parts from a stack of said parts and transferring the separated parts to a predetermined destination comprising:
means forming a support surface for at least part of said stack;
means including a member engageable only with a first part of said stack for moving said first part substantially in its support plane relative to said stack to separate and transfer said first part from said stack to a predetermined destination; and
means for vibrating said member during engagement with said first part for vibrating said first part relative to the remaining parts in said stack to separate said first part from said stack.

16. The apparatus set forth in claim 15 wherein:
said means for vibrating includes a vibrator mechanism for applying cyclical movement to said member in a preselected direction relative to said surface.

17. The apparatus set forth in claim 16 including:
means on said vibrator mechanism for preselecting the direction of resultant vibratory forces exerted on said member and said first part.

18. The apparatus set forth in claim 15 including:
vacuum producing means associated with said means engageable with said first part for providing a fluid pressure force acting on at least a portion of said first part to assist in separating said first part from said stack and holding said first part engaged with said member.

19. Apparatus for separating apparel parts from a stack of said parts and transferring the separated parts to a predetermined destination comprising:
means forming a support surface for at least part of said stack;
means including a member engageable only with a first part of said stack for moving said first part relative to said stack to separate and transfer said first part from said stack to a predetermined destination, and carriage means operably connected to said member and supported above said surface for linear movement relative to said surface for said member to separate said first part from said stack and transfer said first part to said destination, said carriage means including a plate including said member, and flexible means for supporting said plate on said carriage means for movement between positions of said member for engagement with and disengagement from said parts, respectively; and
means for vibrating said member during engagement with said first part for vibrating said first part relative to the remaining part in said stack to separate said first part from said stack and including a vibrator mechanism mounted on said plate for applying cyclical movement to said member in a preselected direction relative to said surface.

20. Apparatus for separating apparel parts from a shingled stack of said parts and feeding said separated parts seriatim to a predetermined destination wherein said parts each include a marginal edge, said marginal edges of said parts are spaced apart one from the other and the first part to be separated is positioned at the top of the stack overlying additional parts in the stack to be separated subsequently, said apparatus comprising:
means forming a support surface for supporting at least the first part to be separated from said stack;
means for feeding said stack to a predetermined position of said first part on said surface; and
means operable for mechanically engaging said first part and moving said first part away from said stack to said destination.

21. The apparatus set forth in claim 20 wherein:
said edges of said parts are formed by a hem, said hem forming a hem edge for positive interlocking engagement with said means for engaging said first part.

22. The apparatus set forth in claim 21 including:
means forming a guide surface on said apparatus for engagement with said marginal edge of a separated part; and
carriage means movable relative to said surface for transferring said parts seriatim to registration of said marginal edge of each of said parts with a guide surface.

23. The apparatus set forth in claim 20 including:
means for retaining a second part to be separated from said stack from movement with said first part during separation of said first part from said stack.

24. The apparatus set forth in claim 23 wherein:
said means for retaining said second part includes orifice means in said surface and vacuum producing means for generating a pressure force acting on said second part to hold said second part from movement on said surface with said first part.

25. The apparatus set forth in claim 20 wherein:
said feed means includes spaced apart parallel conveyor means and means for operating said conveyor means to orient a leading edge of said first part in a predetermined direction relative to said support surface prior to engaging and moving said first part away from said stack.

26. Apparatus for separating apparel parts from a shingled stack of said parts and feeding said separated parts seriatim to a predetermined destination wherein said parts each include a hemmed marginal edge, said marginal edges of said parts being spaced apart one from the other, said apparatus comprising:
means forming a support surface for supporting at least the first part to be separated from said stack;
means for feeding said stack to a predetermined position on said surface; and
means for engaging said first part in a positive interlock with the hemmed edge thereof and moving said first part away from said stack to said destination
and including a member engageable with said hem edge and vibrator means for vibrating said member during engagement of said first part to reduce frictional resistance to separation of said first part from said stack.

27. Apparatus for separating apparel parts from a shingled stack of said parts and feeding said separated parts seriatim to a predetermimed destination wherein said parts each include a marginal edge, said marginal edges of said parts being spaced apart one from the other, said apparatus comprising:

means forming a support surface for supporting at least the first part to be separated from said stack;

means for feeding said stack to a predetermined position of said first part on said surface;

means for engaging said first part and moving said first part away from said stack to said destination; and means for retaining a second part to be separated from said stack from movement with said first part during separation of said first part from said stack including orifice means in said surface and vacuum producing means for generating a pressure force acting on said second part to hold said second part from movement on said surface with said first part, retractable needle means and actuator means for moving said needle means with respect to said second part to hold said second part during separation of said first part from said stack.

28. Apparatus for separating apparel parts from a shingled stack of said parts and feeding said separated parts seriatim to a predetermined destination, wherein said parts each include an edge spaced from corresponding edges on the other parts in said stack, said apparatus comprising:

means forming a support surface for supporting at least a portion of said stack including the first part to be separated from said stack;

conveyor means for feeding said stack to a predetermined position on said surface;

means operable for mechanically engaging said first part and moving said first part away from said stack to said destination; and means for sensing the absence of said first part at said predetermined position on said surface for effecting operation of said conveyor means to move said stack of parts to a position wherein said edge of a part to be next separated from said stack is disposed at said predetermined position.

29. The apparatus set forth in claim 28 including:

vacuum means for holding the part next to said first part stationary during separation of said first part from said stack, said vacuum means including orifice means formed in said surface and connected to a source of vacuum.

30. The apparatus set forth in claim 28 including:

vacuum means on said means for engaging said first part for producing a fluid pressure force acting on at least a portion of said first part to assist in separating said first part from said stack.

31. The apparatus set forth in claim 28 wherein:

said means for engaging said first part includes a member engageable with said first part and vibrator means for vibrating said member during engagement of said first part to reduce frictional resistance to separation of said first part from said stack.

32. The apparatus set forth in claim 28 wherein:

said conveyor means includes spaced apart conveyors, each conveyor including drive means, and means for sensing the presence of said edge of a part for operating said conveyors to orient said edge of each part relative to said support surface prior to moving a part away from said stack.

33. Apparatus for separating apparel parts from a shingled stack of said parts and feeding said separated parts seriatim to a predetermined destination, wherein said parts each include an edge spaced from corresponding edges on the other parts in said stack, said apparatus comprising;

means forming a support surface for supporting at least a portion of said stack including the first part to be separated from said stack;

conveyor means for feeding said stack to a predetermined position on said surface;

means including a member engageable with said first part for moving said first part away from said stack to said destination;

said member being supported on carriage means including a first support plate, a second support plate, flexible means interconnecting said plates and providing for movement of said second support plate relative to said first support plate, and actuator means for moving said second support plate and said member between positions for engagement with and disengagement from said parts to be separated from said stack;

vibrator means for vibrating said member during engagement of said first part to reduce frictional resistance to separation of said first part from said stack; and means for sensing the absence of said first part at said predetermined position on said surface for effecting operation of said conveyor means to move said stack of parts to a position wherein said edge of a part to be next separated from said stack is disposed at said predetermined position.

34. The apparatus set forth in claim 33 wherein:

said vibrator means is mounted on said second support plate for vibrating said second support plate and said member.

35. A method for separating apparel parts from a stack of such parts comprising the steps of:

providing a support surface;

providing a shingled stack of parts wherein an edge of each of said parts extends above and beyond the adjacent edge of an adjacent part in the direction that the first to be separated part is to be moved during separation;

presenting said stack to said support surface;

applying a holding force to a second to be separated part in said stack;

applying a separating force to the first part on said stack to separate said first part from said stack;

mechanically engaging said first part; and mechanically moving said first part by said mechanical engagement to a destination away from said stack.

36. The method set forth in claim 35 including the step of:

vibrating said first part while moving said first part separate from said second part during at least an initial portion of separating said first part from said stack.

37. The method set forth in claim 35 wherein:

the step of moving said first part includes positioning said first part against a reference surface and then disconnecting said separating force.

38. The method set forth in claim 35 including the steps of:

providing conveyor means for presenting said stack to said support surface; and operating said conveyor means to feed said stack to said support surface to present an edge of the first to be separated part on said stack at a predetermined point on said support surface.

39. The method set forth in claim 38 including the step of:

operating said conveyor means to turn said stack to orient said edge of said first to be separated part in a predetermined direction relative to said support surface prior to separating said first part from said stack.

40. The method set forth in claim 35 including the steps of:

providing apparatus for producing said stack;

providing a plurality of support surfaces for receiving shingled stacks from a plurality of associated conveyor means;

providing transfer means for transferring a shingled stack from said apparatus to selected ones of said conveyor means; and selectively transferring shingled stacks from said apparatus to each of said conveyor means.

41. Apparatus for separating apparel parts from a shingled stack of said parts and feeding said separated parts seriatim to a predetermined destination, comprising:

means forming a support surface for supporting at least a portion of said stack including the first part to be separated from the top of said stack at a predetermined position on said surface;

holddown means in the proximity of said position acting on the second part to be separated from said stack for holding said second part against being displaced; and means operable for mechanically engaging said first part and moving said first part away from said stack to said destination concomitantly with the acting of said holddown means on said second part.

42. The apparatus set forth in claim 41 wherein:

said means for engaging said first part includes a member mechanically engageable with said first part and vibrator means for vibrating said member during engagement of said first part to reduce frictional resistance to separation of said first part from said second part.

* * * * *